United States Patent [19]

Mochida et al.

[11] Patent Number: 4,891,126

[45] Date of Patent: Jan. 2, 1990

[54] MESOPHASE PITCH FOR USE IN THE MAKING OF CARBON MATERIALS AND PROCESS FOR PRODUCING THE SAME

[75] Inventors: Isao Mochida, Fukuoka; Yukio Sakai; Hiroyuki Otsuka, both of Okayama, all of Japan

[73] Assignee: Mitsubishi Gas Chemical Company, Inc., Tokyo, Japan

[21] Appl. No.: 276,468

[22] Filed: Nov. 22, 1988

[30] Foreign Application Priority Data

Nov. 27, 1987 [JP] Japan ..... 62-297760
Apr. 4, 1988 [JP] Japan ..... 63-81219

[51] Int. Cl.[4] ..... C10C 1/20

[52] U.S. Cl. ..... 208/39; 208/22; 208/44; 585/11; 585/422; 585/426; 423/447.4; 252/299.62; 528/247

[58] Field of Search ..... 208/22, 39, 44; 585/11, 585/422, 426; 252/299.62; 423/447.4; 528/247

[56] References Cited

U.S. PATENT DOCUMENTS

| | | | |
|---|---|---|---|
| 4,005,183 | 1/1977 | Singer | 423/445 |
| 4,016,247 | 4/1977 | Otani et al. | 423/447.4 |
| 4,032,430 | 6/1977 | Lewis | 208/39 |
| 4,208,267 | 6/1980 | Diefendorf et al. | 208/22 |
| 4,209,500 | 6/1980 | Chwastiak | 423/447.6 |
| 4,457,828 | 7/1984 | Lewis | 585/11 |
| 4,472,265 | 9/1984 | Otani | 208/22 |
| 4,512,874 | 4/1985 | Watanabe | 208/22 |
| 4,533,461 | 8/1985 | Izumi et al. | 208/44 |
| 4,534,850 | 8/1985 | Izumi et al. | 208/22 |
| 4,591,424 | 5/1986 | Gomi et al. | 208/40 |
| 4,715,945 | 12/1987 | Dickakian | 208/40 |
| 4,789,455 | 12/1988 | Mochidu et al. | 208/39 |

FOREIGN PATENT DOCUMENTS

| | | |
|---|---|---|
| 0054437 | 6/1982 | European Pat. Off. . |
| 0257303 | 3/1988 | European Pat. Off. . |
| 1117533 | 3/1978 | Japan . |
| 1118421 | 2/1983 | Japan . |
| 136835 | 8/1983 | Japan . |
| 2164351 | 3/1986 | United Kingdom . |

*Primary Examiner*—Helane Myers
*Attorney, Agent, or Firm*—Browdy and Neimark

[57] ABSTRACT

Pitch that is obtained from a condensed polycyclic aromatic hydrocarbon and the content of an optically anisotropic phase in which is substantially 100% is disclosed. This mesophase pitch has a H/C atomic ratio of 0.5–1.0, contains naphthenic carbon in an amount of at least 7% of the total carbon, and has a softening point of 180°–400° C. Fibers melt-spun from this mesophase pitch can be converted to carbon or graphite fibers having high strength and modulus of elasticity by a heat treatment which consists of heating to a temperature of 250°–300° C. in an air atmosphere, then heating to 1,000° C. or higher in an inert gas atmosphere. Such mesophase pitch is produced by polymerizing a condensed polycyclic aromatic hydrocarbon for 5–300 minutes at a temperature of 180°–400° C. and at a pressure of 5–100 atmospheres in the presence of 0.1–20 moles of HF and 0.05–1 mole of $BF_3$ per mole of the condensed polycyclic aromatic hydrocarbon.

24 Claims, No Drawings

MESOPHASE PITCH FOR USE IN THE MAKING OF CARBON MATERIALS AND PROCESS FOR PRODUCING THE SAME

FIELD OF INVENTION

The present invention relates to mesophase pitch for use in the production of high-performance carbon fibers and other carbon materials, as well as a process for producing such mesophase pitch. More particularly, the present invention relates to high-quality mesophase pitch of high mesophase content that is prepared from condensed polycyclic aromatic hydrocarbons having naphthalene, anthracene, pyrene and like carbon skeletons and which can be easily stabilized with the added advantage of high yield in carbonization. The present invention also relates to a process for producing such high-quality mesophase pitch.

PRIOR ART

High-performance carbon fibers are commercially produced chiefly from PAN (polyacrylonitrile). However, PAN is expensive and does not show high yield in carbonization. It has recently been found that carbon fibers which have comparable or better characteristics than those prepared from PAN can be produced from inexpensive pitch, and active efforts are being made to commercialize this method.

There are two types of pitch that can be used as a starting material for the manufacture of carbon materials; isotropic pitch and anisotrophic pitch. Either type of pitch can be produced by polymerizing naphthalene and other hydrocarbons. This process consists basically of heat-treating the hydrocarbon material at 100°-300° C. in the presence of a Lewis acid catalyst such as aluminum chloride, removing the added catalyst by such a technique as solvent extraction, precipitation or filtration, and further heat-treating the residue at 300°-500° C. Various versions of this method are described not only in Journal of Materials Science, 20, pp. 3177-3183 (1985) but also in patents such as U.S. Pat. No. 4,457,828, Japanese Patent Publication No. 7533/1978 and G.B. Pat. No. 2,164,351.

In all of these methods which involve the use of an aluminum chloride catalyst, the spent catalyst must be removed by some special technique from the pitch obtained by polymerization and this makes it difficult to recover the catalyst efficiently for further use.

Another problem with these methods is its inability to prepare mesophase pitch directly by a one-step treatment and the residue that is left after catalyst removal must be heat-treated at a higher temperature.

In addition, if the pitch produced is used as a precursor for the manufacture of carbon fibers, a trace amount of aluminum chloride or a derivative thereof remains in the carbon fibers being prepared, with the subsequent result that the strength and other properties of the fibers are considerably deteriorated during their calcination or graphitization. It is extremely difficult to remove such aluminum chloride or derivatives thereof from the pitch or the fibers.

An improved process for producing pitch from a condensed polycyclic aromatic hydrocarbon which facilitates the recovery of a catalyst and which hence is free from the problem of contamination of the final carbon product by residual catalyst has been developed and disclosed in commonly assigned U.S. Ser. No. 77,211 (filed Jul. 11, 1987 now U.S. Pat. No. 4,789,455; E.P. Appln Publication No. 0257303). The process for pitch production described in this U.S. patent application consists of polymerizing a condensed polycyclic aromatic hydrocarbon in the presence of a catalyst system composed of 3-20 moles of hydrogen fluoride and 0.1-1.0 mole of boron trifluoride per mole of the hydrocarbon material. The polymerization temperature used in the process disclosed in this U.S. patent application ranges from 0° to 150° C. The pitch obtained by the disclosed method is not mesophase pitch and in order to convert it to mesophase pitch, the product must be further heat-treated for a prolonged period of time at an elevated temperature. According to Example 3 given in the specification of this U.S. patent application, the yield of mesophase pitch that was obtained by heat-treating the pitch product at 380° C. for 10 hours was 40 wt%. Comparative Example 1 of the present invention shown herein is concerned with the repetition of the method disclosed in said prior U.S. application and as the results of that comparative example show, the disclosed method is incapable of producing mesophase pitch that has the improved properties described herein.

Carbon products, for example, carbon fibers, produced from pitch derived from condensed polycyclic aromatic hydrocarbons are inexpensive if the pitch is isotropic but they suffer from the disadvantage of low strength due to poor molecular orientation. Therefore, high-performance carbon products cannot be produced from isotropic pitch. In contrast, carbon fibers produced from anisotropic pitch called "mesophase pitch" have a higher degree of molecular orientation and exhibit improved mechanical properties in terms of strength and modulus of elasticity. Therefore, with a view to producing high-performance carbon fibers, extensive studies are being conducted on the production of mesophase pitch from catalytic cracked oil pitch, petroleum tar pitch or coal tar pitch. When fibers are produced by a melt spinning process using mesophase pitch, the developed aromatic planar molecules are brought into alignment with the fiber axis by the shear force exerted as the pitch passes through nozzle holes. This oriented structure is maintained without being disturbed during the stage of subsequent "stabilization" in which the surface of fibers is oxidized by gradual heating under an air current and during the stage of "carbonization" in which the stablized fibers are heat-treated in an inert gas atmosphere at temperatures not lower than 1,000° C. It has been confirmed by many experiments that this effect contributes to the production of highly oriented, high-performance carbon fibers.

The portion of pitch which has an optically anisotropic phase (this portion is hereinafter referred to as "mesophase") is insoluble in polar solvents such as quinoline and pyridine and it has so far been considered that mesophase is identical to the component which is insoluble in polar solvents. However, later studies have shown that the portion which exhibits anisotropy when observed under a polarizing microscope is not necessarily the same as the insoluble content but that mesophase contains both components which are insoluble and soluble in polar solvents. Therefore, the term "mesophase" as used herein means that portion of a phase which shows optical anisotropy when observed under a polarizing microscope, and the proportion taken by the area of this optically anisotropic phase under observation with a polarizing microscope shall be called "the content of mesophase", or more simply "the mesophase content".

If the mesophase content of pitch is small, the anisotropic phase and isotropic phase in molten pitch will separate to interfere with the spinning operation. Therefore, the mesophase content of pitch is preferably at least 90%, more preferably 100%. However, an increase in the mesophase content generally causes an increase in the softening point and viscosity of the pitch and renders it difficult to perform spinning with consistent results. The high softening point and viscosity necessitate spinning at elevated temperatures but then the pitch is prone to thermal decomposition or condensation, and the resulting gases and infusible high-molecular weight substances make it difficult to continue spinning operations for a prolonged time with consistent results.

Various methods have been proposed for solving these problems with mesophase pitch. E.P. Appln, Publication No. 54437 shows a method in which the mesophase pitch is partially hydrogenated to reduce the degree of stacking of its molecules to an appropriate degree and the resulting "isotropic pitch" is subjected to spinning. Japanese Patent Public Disclosure No. 18421/1983 shows a method characterized by the use of a unique kind of pitch, or "premesophase" pitch which is isotropic during spinning but which turns anisotropic during carbonization. U.S. Pat. No. 4,208,267 shows a method in which isotropic pitch is subjected to solvent extraction, followed by heating the insoluble matter at 230°–400° C. Japanese Patent Public Disclosure No. 136835/1983 shows a method in which isotropic pitch is heat-treated and the resulting mesophase is filtered off, with the remaining pitch being subjected to another heat treatment. U.S. Pat. No. 4,533,461 shows a method in which pitch is heat-treated to adjust the mesophase content to be within the range of 20–80%, followed by precipitation and recovery of the mesophase.

While these methods are improved in one way or another in the use of mesophase pitch, they still have the problems to be described below and completely satisfactory results are yet to be attained by these methods.

In the methods described in E.P. Appln. Publication No. 54437 and Japanese Patent Public Disclosure No. 18421/1983, spinning is performed on isotropic pitch which is not highly oriented, so the molecular orientation in the fibers is not as high as in the fibers spun from anisotropic pitch and the fiber performance is rather low in such aspects as strength and modulus of elasticity. In addition, the method involving the hydrogenation of highly viscous pitch in which the polymerized molecules of a condensed polycyclic aromatic compound are stacked one on another is complicated and is not advantageous for industrial applications.

In the method described in U.S. Pat. No. 4,208,267, only a small amount of the insoluble matter is extracted with a solvent and the yield of mesophase pitch is low. The method described in Japanese Patent Public Disclosure No. 136835/1983 has the disadvantage of complexity in the procedure of filtration to be performed after the heat treatment. The method described in U.S. Pat. No. 4,533,461 involves technical difficulty in recovering the mesohase and suffers the disadvantage of low yield in cabonization.

As already mentioned, the mesophase content of mesophase pitch for use in the production of carbon materials has to be increased in order to provide high performance in such aspects as strength and modulus of elasticity. The mesophase content of the pitch must also be increased for the purpose of facilitating spinning operations in the production of carbon fibers. Additional requirements include high stabilization reactivity of the spun fibers and high yield in carbonization. In the case of producing carbon materials, the yield of the carbon material produced by carbonization of the pitch must also be high.

Therefore, the mesophase pitch for use in the production of carbon materials is required to satisfy the following conditions: (1) high mesophase content, (2) high heat stability during spinning operations, (3) high stabilization reactivity, and (4) high yield in carbonization.

SUMMARY OF INVENTION

The present inventors conducted intensive studies in order to develop mesophase pitch having the characteristics described above. As a result, the present inventors reached the idea of polymerizing a condensed polycyclic aromatic hydrocarbon having naphthalene, anthracene, phenanthrene, acenaphtene, pyrene or like carbon skeltons at a specified high temperature in the presence of a hydrogen fluoride/boron trifluoride which is a super-strong acid catalyst characterized by the combination of a Brönsted acid with a Lewis acid. According to this method, mesophase pitch that has a mesophase content of at least 90% and which therefore need not be subsequently heat-treated for conversion to mesophase can be produced in one step. This mesophase pitch has a hydrogen-to-carbon ratio in a certain range and is high in naphthenic carbon content. Since this pitch satisfies the four requirements set forth above, it is suitable for use in the production of high-performance carbon products and can be spun into fibers in an easy and consistent way. Furthermore, the spun fibers can be efficiently stabilized with the added advantage of high yield in subsequent carbonization. The present invention has been accomplished on the basis of these findings.

In accordance with the present invention, mesophase pitch for use in the production of carbon materials is produced by polymerizing a condensed polycyclic aromatic hydrocarbon or a substance that contains it. This pitch has a hydrogen-to-carbon atomic ratio of from about 0.5 to about 1.0, contains naphthenic carbon in an amount of at least about 7% of the total carbon, and contains at least about 90% of an optically anisotropic phase.

The present invention also provides a process for producing the above-described mesophase pitch for use in the production of carbon materials by polymerizing a condensed polycyclic aromatic hydrocarbon or a substance that contains it at about 180°–400° C. in the presence of a hydrogen fluoride/boron trifluoride catalyst.

DETAILED DESCRIPTION OF THE INVENTION

The carbon and hydrogen contents of the mesophase pitch of the present invention are measured with an automatic analyzer (CHN coder) utilizing a detection technique that measures the thermal conductivity of combustion gases. The naphthenic carbon content of the pitch is measured by NMR analysis.

The hydrogen to carbon atomic ratio of the mesophase pitch for use in the production of carbon materials of the present invention is in the range of from about 0.5 to about 1.0, preferably from about 0.6 to about 0.7. If the atomic ratio of hydrogen to carbon is less than about 0.5, the resulting pitch suffers the problem of excessive dehydrogenation compared to polymerization and its softening point is so much increased as to render subsequent spinning and other processing operations difficult. If the hydrogen to carbon atomic ratio is higher than about 1.0, the resulting pitch has a low degree of orientation either on account of insufficient degree of polymerization or because of the presence of too many saturated rings, and this makes it impossible to obtain carbon fibers or other carbon materials having desired performance in such aspects as strength and modulus of elasticity.

The naphthenic carbon content of the mesophase pitch of the present invention is at least about 7%, preferably at least about 9%, of the total carbon content. If the naphthenic carbon content is less than about 7%, the pitch is not highly adaptable for stabilization and an unduly long time is required to complete the stabilization of the pitch.

As already mentioned, the content of mesophase (i.e., optically anisotropic phase) in the pitch of the present invention is measured by observation with a polarizing microscope. The pitch of the present invention has a mesophase content of at least about 90%, preferably at least about 95%. More preferably, substantially all part of the pitch is composed of mesophase. If the mesophase content of the pitch is less than about 90%, carbon fibers or other carbon materials produced from the pitch will have low performance in such aspects as strength and modulus of elasticity. As already mentioned, the mesophase content must also be high in order to ensure efficient spinning operations.

The mesophase pitch of the present invention generally has a softening point which ranges from about 180° to about 400° C.

The starting material for the production of the mesophase pitch for use in the production of carbon materials of the present invention is a compound selected from the group consisting of condensed polycyclic aromatic hydrocarbons having naphthalene, anthracene, phenanthrene, acenaphthene, acenaphthylene, pyrene or like carbon skeletons (e.g., an alkyl-having condensed polycyclic aromatic hydrocarbon such as methylnaphthalene), and mixtures of these hydrocarbon compounds. Materials containing these compounds are also usable and they include various petroleum fractions, the residual oil originating from petroleum processing steps, and coal tar fractions.

The mesophase pitch of the present invention is produced by polymerizing the above-listed starting materials using a hydrogen fluoride/boron trifluoride catalyst as a polymerization catalyst. In this regard, particularly suitable starting materials are those which have low contents of nitrogen-, sulfur- and oxygen-containing compounds, all being basic compounds that strongly bind to the hydrogen fluoride/boron trifluoride catalyst. The polymerization catalyst is preferably used in such an amount that from about 0.1 to about 20 moles of hydrogen fluoride and from about 0.05 to about 1.0 mole of boron trifluoride are present per mole of the condensed polycyclic aromatic hydrocarbon. Even if more than about 20 moles of hydrogen fluoride or more than about 1.0 mole of boron trifluoride is used, there will be no corresponding increase in the rate of reaction. To the contrary, the circulation of the catalyst is increased, leading to the need to employ a large-size reactor. If less than about 0.1 mole of hydrogen fluoride or less than about 0.05 moles of boron trifluoride is used, mesophase pitch with a mesophase content of at least 90% is not attainable. Hydrogen fluoride or boron trifluoride used alone is not effective as a polymerization catalyst, so they must be used in combination in the present invention.

Hydrogen fluoride (HF), when used together with boron trifluoride ($BF_3$), forms a strong protic acid, which reacts with the basic condensed polycyclic aromatic hydrocarbon to form a complex.

The temperature for obtaining the desired mesophase by polymerization reaction ranges from about 180° to about 400° C., preferably from about 250° to about 320° C. If the temperature is higher than about 400° C., polymerization proceeds excessively and the resulting pitch will have an unduly high softening point. If the temperature is lower than about 180° C., mesophase pitch having a mesophase content of at least 90% is not attainable.

The time required to complete the polymerization reaction varies with the type of starting material used, the temperature and the amount of catalyst used, but it is typically within the range of from about 5 to about 300 minutes, preferably from about 30 to about 240 minutes. The pressure for the polymerization reaction generally ranges from about 5 to about 100 atmosphere, preferably from about 20 to about 50 atmospheres.

The polymerization reaction is performed by mixing under agitation the starting material and the catalyst fed into a corrosion-resistant reactor equipped with a stirrer. The procedures of reaction may be batchwise or continuous.

The condensed polycyclic aromatic hydrocarbon (Ar) fed as the starting material forms a complex when mixed with the catalyst and undergoes rapid polymerization to form a polymer in complex form according to the following scheme:

$$HF + BF_3 + (Ar)_m \rightleftharpoons H^+(Ar)_n BF_4^- \quad (1)$$

The resulting polymer in complex form is in equilibrium as shown by equation (1), so after completion of the polymerization the volatile components, HF and $BF_3$, are distilled off at the polymerization temperature and recovered as catalyst components. At the same time, some volatile fractions are recovered and the polymeirzed pitch is separated.

Specific procedures for separating and recovering the catalyst from the pitch are as follows.

Catalyst separation by a batch system consists of holding the polymerization temperature after the polymerization reaction has been completed, and withdrawing HF and $BF_3$ as a vapor phase from the reactor, with the polymer recovered as molten pitch. The heating effected for this purpose may be indirect (external heating through a jacket, etc.) or direct (by introducing the heated vapor of a diluent such as benzene, toluene or halogenated hydrocarbon which are comparatively inert to the catalyst).

Catalyst separation may also be performed by a continuous method in a distillation column, with the inert diluent being refluxed, which is continuously supplied with the polymerization reaction solution so as to extract the HF and $BF_3$ vapors from the top of the column, with the pitch being recovered from the bottom of the column in the form of a solution in the diluent.

Whichever method is used, the temperature necessary for recovering the catalyst is the same as the temperature for polymerization, whereas the pressure for the catalyst recovery is generally within the range of from about 0 to about 30 atmospheres, preferably from about 1 to about 5 atmospheres.

The pitch obtained by the procedures described above is characterized by high mesophase content, a H/C atomic ratio of from about 0.5 to about 1.0, and a naphthenic carbon content of at least about 7%. This pitch has the additional advantage of high yield in carbonization.

The pitch described above is mesophase pitch which is substantially free of HF and $BF_3$ and which has an anisotrophic phase of at least about 90%. It can be used as a starting material for the production of carbon fibers and other carbon materials without being subjected to any special treatment. For instance, this mesophase pitch can be readily spun into fibers at a spinning temperature of from about 280° to about 340° C. The spun pitch figbers have such a high stabilization reactivity that they can be satisfactorily stabilized by heating up to a temperature of about 270° C. at a rate of about 5° C./min under an air current. This ease of stablization can be ascribed to the high content of naphthenic carbon in the pitch.

Carbon fibers may be produced from the pitch of the present invention by the following procedures: the pitch is first extruded through a nozzle (ca. 0.25 μm) in a nitrogen atmosphere at a pressure of from about 1 to about 3 $kg/cm^2G$ and at a temperature of from about 280° to about 340° C. and the filaments are wound up on a roll at a take-up speed of, say, about 500 m/min; then, the filaments are stabilized by heating from ambient temperature to a temperature between about 250° and about 300° C. at a typical rate of from about 1 to about 5° C./min under an air current; finally, the stabilized fibers are carbonized or graphitized by heating to 1,000° C. or above at a typical rate of about 10° C./min in an inert gas stream such as nitrogen.

The mesophase pitch of the present invention and the process for producing it have the following advantages.

(1) In accordance with the process of the present invention, the condensed polycyclic aromatic hydrocarbons described herein may be individually used as the starting material for the production of mesophase pitch. Alternatively, various tar oils containing one or more of these condensed polycyclic aromatic hydrocarbons can also be used as starting materials.

(2) According to the method of the present invention, HF and $BF_3$ used as catalyst components can be readily separated from the polymerization system and may be subjected to further use as catalyst components.

(3) In the method of the present invention, no further heat treatment need be performed after polymerization, and the desired mesophase pitch can be obtained in high yield in one step. Under the conditions set forth herein, mesophase pitch that has a softening point of from about 180° to about 400° C. and which contains at least about 90% of an optically anisotropic phase can be obtained. This pitch is readily spinnable and the spun filaments may be stabilized, carbonized, and optionally graphitized, to make high-strength carbon or graphite fibers.

(4) The pitch produced by the process of the present invention contains such a great amount of naphthenic carbon that it can be easily stabilized.

(5) The mesophase pitch of the present invention has a high content of quinoline-soluble matter, so its viscosity is sufficiently reduced to ensure that it can be spun at a temperature that is much lower than the point at which it starts to decompose.

(6) The mesophase pitch of the present invention can be stabilized without employing any complex and costly steps such as filtration of infusible matter at high temperature and solvent extraction thereof. The pitch of the present invention is composed of a substantially homogeneous mesophase and can be spun into carbon fibers at a temperature between about 280° and about 340° C., which is appreciably lower than the conventionally employed temperature range.

(7) The mesophase pitch of the present invention can be spun into fibers at a temperature that is much lower than the point at which marked thermal decomposition or polycondensation occurs (ca. 400° C.). Therefore, the spinnability of the pitch is good enough to resist deterioration during spinning and carbon fibers of consistent quality can be produced.

(8) In the absence of the evolution of any decomposition gases as well as the formation of infusible matter, the pitch of the present invention can be spun at high speed and the spun pitch fibers have so few defects that carbon fibers of high strength can be produced.

(9) The mesophase pitch of the present invention has a high anisotropic phase content of at least about 90%, so carbon fibers produced from this pitch are characterized by well developed orientation in the direction of fiber axis and exhibit high modulus of elasticity.

(10) In spite of this high content of anisotropic phase, the mesophase pitch of the present invention has a high H/C atomic ratio and the proportion of naphthenic carbon in the total carbon content is high enough to enhance the adaptability of the pitch for stabilization.

(11) The mesophase pitch of the present invention ensures high yield in carbonization because of its high degree of polymerization.

For these features (1) to (11), the present invention offers great benefits to industry.

The following examples are provided for the purpose of further illustrating the present invention but are in no way to be taken as limiting.

EXAMPLE 1

Naphthalene (1 mole) and HF (6 moles) were charged into an acid-resistant autoclave and $BF_3$ (0.5 moles) was fed into the autoclave with gentle stirring. As $BF_3$ was supplied, naphthalene dissolved and its polymerization started immediately. The temperature in the autoclave was raised to 300° C. with the reaction pressure maintained at 25 $kg/cm^2G$ and stirring was continued for 2 hours to complete the reaction. Thereafter, the release valve on the autoclave was opened so that substantially all of the HF and $BF_3$ charged could be recovered in a gaseous form at an atmospheric pressure. Thereafter, nitrogen was blown into the autoclave to remove the low-boiling point components. The yield of the pitch obtained was 75% of the weight of the naphthalene supplied. Under observation with a polarizing microscope, this pitch was found to be 100% anisotropic mesophase pitch, with a softening point of 239° C. and a H/C atomic ratio of 0.66. The naphthenic carbon content was 12% of the total carbon and the content of quinoline-insoluble matter was 29 wt%. This mesophase pitch was readily spinnable at 310° C. and had high stabilization reactivity. After carbonaization, high-quality carbon fibers were obtained.

EXAMPLE 2

Naphthalene (0.5 moles), HF (3 moles) and $BF_3$ (0.25 moles) were charged into an acid-resistant autoclave as in Example 1. The temperature in the autoclave was raised to 280° C. with the reaction pressure held at 25 kg/cm$^2$G, and the reaction was performed with stirring for 2 hours. Thereafter, the catalyst was recovered and the low-boiling point components removed as in Example 1. Mesophase pitch that was solely composed of an anisotropic phase was obtained in a yield of 77%. This pitch had a softening point of 200° C. and a H/C atomic ratio of 0.7. The naphthenic carbon content was 16% of the total carbon and the content of quinoline-insoluble matter was 20 wt%. The pitch could be easily spun at 270° C.

EXAMPLE 3

Anthracene (0.5 moles), HF (3 moles) and $BF_3$ (0.25 moles) were supplied into an acid-resistant autoclave as in Example 1. The temperature in the autoclave was raised to 250° C. with the reaction pressure held at 25 kg/cm$^2$G; and the reaction was performed with stirring for 1.5 hours. Thereafter, the catalyst was recovered and the low-boiling point components removed as in Example 1. Mesophase pitch that was solely composed of an anisotropic phase was obtained in a yield of 93%. This pitch had a softening point of 240° C. and a H/C atomic ratio of 0.65. The naphthenic carbon content was 12% of the total carbon and the content of quinoline-insoluble matter was 29 wt%. The pitch could be easily spun at 310° C.

EXAMPLE 4

Naphthalene (0.5 moles), HF (0.5 moles) and $BF_3$ (0.1 mole) were supplied into an acid-resistant autoclave as in Example 1. The temperature in the autoclave was raised to 300° C. with the reaction pressure held at 25 kg/cm$^2$G, and the reaction was performed with stirring for 2 hours. Thereafter, the catalyst was recovered and the low-boiling point components removed as in Example 1. Mesophase pitch that was solely composed of an anisotropic phase was obtained in a yield of 60%. This pitch has a softening point of 234° C. and a H/C atomic ratio of 0.66. The naphthenic carbon content was 13% of the total carbon and the content of quinoline-insoluble matter was 29 wt%. The pitch could be easily spun at 310° C.

EXAMPLE 5

Naphthalene (1 mole), HF (0.5 moles) and $BF_3$ (0.5 moles) were charged into a 500-ml acid-resistant autoclave, and after raising the temperature in the autoclave to 260° C. with the reaction pressure held at 25 kg/cm$^2$G, reaction was performed for 2 hours. Thereafter, the release valve on the autoclave was opened so that substantially all of the HF and $BF_3$ charged could be recovered in a gaseous form at an atmospheric pressure. Thereafter, nitrogen was blown into the autoclave to remove the low-boiling point components. The yield of the pitch obtained was 76% of the weight of the naphthalene supplied. When observed with a polarizing microscope, this pitch was found to be 100% anisotropic mesophase pitch, with a softening point of 216° C. and a H/C atomic ratio of 0.67. The naphthenic carbon content of this pitch was 14% of the total carbon.

This mesophase pitch could be spun into fibers at 280° C. and at a take-up speed of 500 m/min without any fiber being broken during spinning. The fibers could be readily stabilized by heating to 270° C. at a rate of 5° C./min.

The stabilized fibers were heated to 1,000° C. at a rate of 10° C./min in an inert gas atmosphere so as to produce carbon fibers having a diameter of 12 μm. The yield in carbonization was 90%, and the carbon fibers produced had a tensile strength of 230 kgf/mm$^2$ and a modulus of elasticity of 20 tf/mm$^2$.

EXAMPLE 6

Naphthalene (7 moles), HF (3 moles) and $BF_3$ (1.4 moles) were charged into a 3-L (litter) acid-resistant autoclave, and the reaction was performed for 2 hours at a raised temperature of 260° C. By performing subsequent operations as in Example 5, pitch was obtained in a yield of 76 wt% of the naphthalene supplied. When observed with a polarizing microscope, this pitch was found to be 100% anisotropic mesophase pitch. It had a softening point of 229° C. and a H/C atomic ratio of 0.66, with the naphthenic carbon content being 13% of the total carbon.

This mesophase pitch could be spun into fibers at 310° C. and at a take-up speed of 500 m/min without any fiber being broken during spinning. The fibers could be readily stabilized by heating to 280° C. at a rate of 5° C./min.

The stabilized fibers were heated to 1,000° C. at a rate of 10° C./min in an inert gas atmosphere so as to produce carbon fibers having a diameter of 11 μm. The yield in carbonization was 90% and the carbon fibers produced had a tensile strength of 220 kgf/mm$^2$ and modulus of elasticity of 18 tf/mm$^2$.

EXAMPLE 7

Naphthalene (7 moles), HF (3.5 moles) and $BF_3$ (1.4 moles) were charged into a 3-L acid-resistant autoclave, and the reaction was performed for 2 hours at a raised temperature of 260° C. By performing subsequent operations as in Example 5, pitch was obtained in a yield of 68 wt% of the naphthalene supplied. When observed with a polarizing microscope, this pitch was found to be 100% anisotropic mesophase pitch. It had a softening point of 244° C. and a H/C atomic ratio of 0.65, with the naphthenic carbon content being 12% of the total carbon.

This mesophase pitch could be spun into fibers at 310° C. and at a take-up speed of 500 m/min without any fiber being broken during spinning. The fibers could be readily stabilized by heating to 260° C. at a rate of 5° C./min.

The stabilized fibers were heated to 1,000° C. at a rate of 10° C./min in an inert gas atmosphere so as to produce carbon fibers having a diameter of 13 μm. The yield in carbonization was 90%, and the carbon fibers produced had a tensile strength of 230 kgf/mm$^2$ and a modulus of elasticity of 26 tf/mm$^2$.

COMPARATIVE EXAMPLE 1

Naphthalene (1 mole), HF (3 moles) and $BF_3$ (0.5 moles) were charged into a 3-L acid-resistant autoclave, and reaction was performed for 3 hours at a raised temperature of 80° C. Thereafter, the release valve on the autoclave was opened and gradual heating to 180°-200° C. was conducted at one atmosphere so that substantially all of the HF and $BF_3$ charged could be recovered in a gaseous form. Thereafter, the pitch in molten state was withdrawn from the autoclave. This pitch had a softening point of 72° C. and contained no mesophase.

This pitch was heat-treated first at 475° C. for 50 minutes under one atmosphere, then at 420° C. for 30 minutes under a reduced pressure of 100 Torr, thereby obtaining 100% mesophase pitch (softening point, 250° C.) in yield of 50% based on naphthalene.

The resulting mesophase pitch had a H/C atomic ratio of 0.51 and the naphthenic carbon content was 4% of the total carbon. This pitch could be spun into fibers at a take-up speed of 300 m/min and at 360° C. but not at a higher take-up speed of 500 m/min. The pitch fibers obtained by spinning at a take-up speed of 300 m/min could not be stabilized by heating up to 270° C. at a rate of 5° C./min.

In this comparative example, naphthalene was polymerized in the presence of a $HF/BF_3$ catalyst and the resulting pitch was converted to mesophase pitch by subsequent heat treatments. However, it turned out that this pitch was not suitable for high-speed spinning and stabilization when it was low in naphthenic carbon content.

What is claimed is:

1. Mesophase pitch for use in the production of a carbon material which is produced by polymerizing a condensed polycyclic aromatic hydrocarbon or a substance that contains it in the presence of a hydrogen fluoride/boron trifluoride catalyst to form mesophase, and vaporizing the catalyst after completion of the polymerization reaction so that it will be separated and recovered from the reaction system, said pitch having a hydrogen-to-carbon atomic ratio of from about 0.5 to about 1.0 with the naphthenic carbon content being at least about 7% of the total carbon, and said pitch containing at least about 90% of an optically anisotropic phase.

2. Mesophase pitch according to claim 1 wherein said condensed polycyclic aromatic hydrocarbon is selected from the group consisting of naphthalene, anthracene, phenanthrene, acenaphthene, acenaphthylene, pyrene, compounds having these carbon skeletons, and mixtures of these compounds.

3. Mesophase pitch according to claim 1 wherein the substance containing a condensed polycyclic aromatic hydrocarbon is selected from the group consisting of petroleum fractions, the residual oil originating from petroleum processing steps, and coal tar fractions.

4. Mesophase pitch according to claim 1 wherein the hydrogen-to-carbon atomic ratio is in the range of from 0.6 to 1.0.

5. Mesophase pitch according to claim 1 wherein the naphthenic carbon content is at least 9% of the total carbon.

6. Mesophase pitch according to claim 1 which contains at least 95% of an optically anisotropic phase.

7. Mesophase pitch according to claim 1 the content of an optically anisotropic phase in which is substantially 100%.

8. Mesophase pitch according to claim 1 which has a softening point in the range of from about 180° to about 400° C.

9. A process for producing mesophase pitch for use in the production of a carbon material by polymerizing a condensed polycyclic aromatic hydrocarbon or a substance that contains it at about 180°–400° C. in the presence of a hydrogen fluoride/boron trifluoride catalyst to form mesophase, and vaporizing the catalyst after completion of the polymerization reaction to separate and recover said catalyst from the reaction system.

10. A process according to claim 9 wherein said condensed polycyclic aromatic hydrocarbon is selected from the group consisting of naphthalene, anthracene, phenanthrene, acenaphthene, acenaphthylene, pyrene, compounds having these carbon skeletons, and mixtures of these compounds.

11. A process according to claim 9 wherein the substance containing a condensed polycyclic aromatic hydrocarbon is selected from the group consisting of petroleum fractions, the residual oil originating from petroleum processing steps, and coal tar fractions.

12. A process according to claim 9 wherein the hydrogen fluoride/boron trifluoride catalyst is composed of from about 0.1 to about 20 moles of hydrogen fluoride and from about 0.05 to about 1 mole of boron trifluoride per mole of the condensed polycyclic aromatic hydrocarbon.

13. A process according to claim 9 wherein the temperature for polymerization is within the range of from about 250° to about 320° C.

14. A process according to claim 9 wherein the polymerization is performed for a period of from about 5 to about 300 minutes.

15. A process according to claim 14 wherein the duration of the polymerization period is from about 30 minutes to about 240 minutes.

16. A process according to claim 9 wherein the polymerization is performed at a pressure within the range of from about 5 to about 100 atmospheres.

17. A process according to claim 16 wherein the pressure for polymerization is from about 20 to about 50 atmospheres.

18. A process according to claim 9 wherein the polymerization is performed by a batch system.

19. A process according to claim 9 wherein the polymerization is performed by a continuous system.

20. A process according to claim 9 wherein the catalyst is vaporized and recovered by a batch system at a pressure within the range of 0–30 atmospheres, with the polymerization temperature being maintained after completion of the polymerization reaction.

21. A process according to claim 20 wherein external heat is applied to maintain the polymerization temperature in the step of catalyst vaporization and recovery.

22. A process according to claim 20 wherein the vapor of a heated inert diluent is introduced into the polymerization reaction mixture so as to maintain the polymerization temperature in the step of catalyst vaporization and recovery, with the catalyst-free pitch being recovered as a solution in the inert diluent.

23. A process according to claim 22 wherein the inert diluent is selected from the group consisting of benzene, toluene and halogenated hydrocarbons.

24. A process according to claim 22 wherein the vaporization and recovery of the catalyst is performed in a distillation column, with the inert diluent being charged, which is continuously supplied with the polymerization reaction solution so as to vaporize the catalyst in the distillation column at the same temperature as that employed in the polymerization and at a pressure within the range of from about 0 to about 30 atmospheres, with the resulting vapor being extracted from the top of the column while the pitch is recovered from the bottom of the column in the form of a solution in the diluent.

* * * * *